US012805687B2

(12) United States Patent
Daniel et al.

(10) Patent No.: US 12,805,687 B2
(45) Date of Patent: Nov. 24, 2026

(54) METHOD FOR AUTONOMOUS PROCESSING OF FLOOR SURFACES

(71) Applicant: BSH Hausgeräte GmbH, Munich (DE)

(72) Inventors: Kristina Daniel, Bad Neustadt (DE); Kai Schmitt, Saal (DE); Frank Schnitzer, Bad Neustadt (DE)

(73) Assignee: BSH Hausgeräte GmbH, Munich (DE)

( * ) Notice: Subject to any disclaimer, the term of this patent is extended or adjusted under 35 U.S.C. 154(b) by 454 days.

(21) Appl. No.: 18/570,208

(22) PCT Filed: May 24, 2022

(86) PCT No.: PCT/EP2022/064031
§ 371 (c)(1),
(2) Date: Dec. 14, 2023

(87) PCT Pub. No.: WO2022/263123
PCT Pub. Date: Dec. 22, 2022

(65) Prior Publication Data

US 2024/0277205 A1 Aug. 22, 2024

(30) Foreign Application Priority Data

Jun. 16, 2021 (DE) ..... 10 2021 206 130.3

(51) Int. Cl.
*G05D 1/02* (2020.01)
*A47L 11/40* (2006.01)

(52) U.S. Cl.
CPC ..... *A47L 11/4061* (2013.01); *A47L 11/4008* (2013.01); *A47L 2201/04* (2013.01)

(58) Field of Classification Search
CPC ..... A47L 11/4061; A47L 11/4008; A47L 2201/04; A47L 9/28; G05D 1/242;
(Continued)

(56) References Cited

U.S. PATENT DOCUMENTS 11,348,269 B1 * 5/2022 Ebrahimi Afrouzi ... G01S 17/48
11,768,494 B2 * 9/2023 Artes ..... G05D 1/0219 701/2

(Continued)

FOREIGN PATENT DOCUMENTS

DE 102015119501 A1 5/2017
DE 102016124901 A1 6/2018

(Continued)

*Primary Examiner* — Masud Ahmed
(74) *Attorney, Agent, or Firm* — Laurence A. Greenberg; Ralph E. Locher; Werner H. Stemer

(57) ABSTRACT

A method for autonomous processing of floor surfaces by way of a mobile, self-driving device, in particular a floor cleaning device such as a suction robot and/or sweeping and/or mopping robot. The method includes the following steps: performing an exploration travel of the mobile, self-driving device in a proposed floor processing region for establishing a surroundings map, detecting obstacles by a detection device, classifying the obstacles as passable or impassable, and traveling over an obstacle classified as passable and/or traveling around an obstacle classified as impassable. There is also described a mobile, self-driving device that is suitable for carrying out such a method.

9 Claims, 2 Drawing Sheets

(58) Field of Classification Search
CPC ..... G05D 1/246; G05D 1/622; G05D 1/6485; G05D 2105/10; G05D 2105/87; G05D 2107/40; G05D 2109/10; G05D 2111/17
See application file for complete search history.

(56) References Cited

U.S. PATENT DOCUMENTS

| | | | | |
|---|---|---|---|---|
| 2015/0223659 | A1* | 8/2015 | Han | A47L 11/4011 134/18 |
| 2019/0179333 | A1* | 6/2019 | Noh | G05D 1/0246 |
| 2020/0125113 | A1* | 4/2020 | Eoh | G06F 18/2413 |
| 2021/0089040 | A1* | 3/2021 | Ebrahimi Afrouzi | G05D 1/0248 |
| 2022/0125255 | A1* | 4/2022 | Choi | A47L 9/2826 |

FOREIGN PATENT DOCUMENTS

| | | | |
|---|---|---|---|
| DE | 102018202436 | A1 | 8/2019 |
| KR | 1020200094816 | A | 8/2020 |
| WO | 2019004742 | A1 | 1/2019 |

* cited by examiner

METHOD FOR AUTONOMOUS PROCESSING OF FLOOR SURFACES

FIELD AND BACKGROUND OF THE INVENTION

The invention relates to a method for the autonomous processing of floor surfaces with the aid of a mobile, self-propelled appliance, in particular a floor cleaning appliance such as a suction and/or sweeping and/or mopping robot. In addition, the invention relates to a mobile, self-propelled appliance with which such a processing can be performed.

Mobile, self-propelled appliances such as, for example, suction robots have the task of autonomously cleaning as much of an entire floor area as possible. However, obstacles such as furniture, furnishings, small objects or door thresholds prevent the suction robot from reaching all areas of the floor. Known suction robots try to overcome thresholds and obstacles if they are on their path of movement. Obstacles that are too large are usually detected by the bumper sensors mounted in the direction of movement. Small obstacles can be driven over by the suction robot. However, in the case of the obstacles above a certain height, the suction robot lacks the ability to drive over them. After a few attempts, the suction robot registers that it cannot overcome the obstacle and then tries to avoid the spot, wherein it is possible in this case that damage has already occurred to the corresponding obstacle.

According to the abilities of the suction robot, it can overcome low thresholds by passing them. For example, it is possible to drive over door thresholds in order to continue the cleaning task. Door thresholds can usually be overcome with sufficient momentum for the suction robot. The suction robot cannot drive over other thresholds, such as floor-level supporting struts on furniture like swing chairs or feet of laundry stands. The suction robot must drive around these. Thresholds having a narrow profile bear the risk that the suction robot becomes stuck after driving onto them and can no longer free itself from the situation. Especially in the case of pieces of furniture that have high-quality surfaces, such as chrome-plated, lacquered surfaces or glass surfaces, attempts by the suction robot to free itself can lead to damage to the surface. In addition, attempts by the suction robot to free itself can cause disturbing and unpleasant noises that impair the user's sense of quality.

SUMMARY OF THE INVENTION

This object is achieved by a method for processing floor surfaces having the features as claimed and by a mobile, self-propelled appliance having the features as claimed. Advantageous embodiments and further embodiments are the subject of the dependent claims.

This object is achieved by a method for processing floor surfaces having the features of claim 1 and by a mobile, self-propelled appliance having the features of claim 9. Advantageous embodiments and further embodiments are the subject of the subordinate claims.

According to the invention, a method for autonomously processing floor surfaces with the aid of a mobile, self-propelled appliance, in particular a floor cleaning appliance such as a suction and/or sweeping and/or mopping robot, comprises the following method steps:

performing an exploratory tour by the mobile, self-propelled appliance in a designated floor processing area to create a surroundings map, detecting obstacles by means of a detection facility, classifying the obstacles as passable or not passable, and driving over an obstacle classified as passable and/or driving around an obstacle classified as not passable.

The solution according to the invention is characterized by classifying identified obstacles on the basis of their position in the surroundings map and classifying them as passable if they are located in an area of a through passage. Other obstacles are classified as not passable and the mobile, self-propelled appliance drives around them before it starts an attempt to drive over them. Damage to these obstacles can thus be advantageously avoided from the outset. The mobile, self-propelled appliance therefore already assesses whether this obstacle can be overcome before attempting to drive over the identified obstacle. In doing so, the mobile, self-propelled appliance classifies the obstacles with the aid of existing map data of the surroundings map. In particular, the mobile, self-propelled appliance identifies an obstacle before driving over it, compares it with information from known map data, classifies it as passable or not passable and reacts accordingly by driving over obstacles classified as passable and/or driving around obstacles classified as not passable.

The solution according to the invention advantageously reduces the risk of the mobile, self-propelled appliance becoming stuck on flat obstacles such as floor-level supporting struts of chairs. The risk of damaging high-quality furniture is also reduced. In addition, the wear marks on the mobile, self-propelled appliance are reduced due to the reduced contact with the furniture. Advantageously, there is less noise during the cleaning process, since, for example, at maximum speed the appliance no longer bangs against or drives onto flat obstacles and becomes stuck, wherein the wheels of the appliance rattle over the obstacle. Due to the reduced risk of the appliance becoming stuck, the cleaning task can usually be advantageously completed without user intervention. The risk of stopping the cleaning is advantageously reduced. The cleaning time can also be reduced, since the appliance does not waste time trying to overcome obstacles.

A mobile, self-propelled appliance is understood in particular to be a floor cleaning appliance, for example a cleaning or lawn mowing appliance, which autonomously processes floor surfaces or lawns, in particular in the household sector. This includes, inter alia, suction and/or sweeping and/or mopping robots such as, for example, robotic vacuum cleaners or robotic lawn mowers. These appliances preferably work during the operation (cleaning operation or lawn mowing operation) without or with as little user intervention as possible. For example, the appliance moves automatically in a predefined space in order to clean the floor according to a predefined and programmed processing strategy.

An exploratory tour is understood to be in particular a reconnaissance tour which is suitable for checking a floor surface to be processed for obstacles, spatial distribution and the like. The aim of an exploratory tour is in particular to be able to assess and/or depict the conditions of the floor processing area to be processed.

A floor processing area is understood to be any spatial area that is intended for processing, in particular cleaning. This can be, for example, a single (living) room or an entire apartment. It can also be understood to be only areas of a (living) room or an apartment that are intended for cleaning.

Obstacles are understood to be any objects and/or items that are located in the floor processing area, for example lying there, and that influence, in particular hinder and/or interfere with the processing by the mobile, self-propelled appliance, such as thresholds, door thresholds, furniture, walls, curtains, carpets and the like.

Passable obstacles are understood in particular to be obstacles that the mobile, self-propelled appliance can drive over due to their low height without said appliance becoming stuck or driving onto them. For example, door thresholds or carpets can be classified as passable obstacles.

Accordingly, not passable obstacles are understood to be obstacles that the mobile, self-propelled appliance cannot drive over due to their height, in other words said appliance would drive into them or become stuck on them, so that the cleaning process would be interrupted.

After the exploratory tour, the mobile, self-propelled appliance knows its surroundings and can pass these on to the user in the form of a surroundings map, for example in an app on a mobile device. The detected obstacles which are passable and not passable are preferably displayed in the surroundings map. It is particularly preferred that the detected obstacles are displayed accordingly depending on their classification. For example, obstacles classified as passable are displayed in a different color, shape or the like than obstacles classified as not passable.

In particular, a surroundings map is understood to be any map suitable for showing the surroundings of the floor processing area with all its obstacles. For example, the surroundings map shows the floor processing area with the obstacles and walls contained therein in a sketch-like manner.

The surroundings map with the obstacles is preferably displayed in the app on a portable additional device. This serves in particular to visualize a possible interaction for the user.

In the present context, an additional device is understood to be in particular any device which is portable for a user and which is arranged outside the mobile, self-propelled appliance, in particular is distinguished from the mobile, self-propelled appliance, and is suitable for displaying, providing, transmitting and/or transferring data, such as, for example, a mobile phone, a smartphone, a tablet and/or a computer or laptop.

In particular, the app, in particular a cleaning app, is installed on the portable additional device and is used for communication between the mobile, self-propelled appliance and the additional device and, in particular, enables visualization of the floor processing area, in other words the living room to be cleaned or the living area to be cleaned. In this case, the app preferably shows the user the area to be cleaned as a surroundings map as well as any obstacles.

A detection facility is understood to be any device that is suitable for preferably reliably detecting passable and not passable obstacles. This is preferably laser-based, sensor-based and/or camera-based.

Classification is understood in particular to be a division of the obstacles and/or objects and/or items into passable or not passable. In addition, further classifications can be performed, such as, for example, into flat and non-flat obstacles, or the like.

In one advantageous embodiment, the classification of the obstacles is performed with the aid of existing map data obtained by the exploratory tour. In particular, the identified obstacles are compared with information from the surroundings map in order to classify or assess them accordingly. It is preferred that the classification is performed by comparing information from the exploratory tour with information obtained when detecting the obstacle. It is particularly preferred that in order to perform the classification the mobile, self-propelled appliance automatically identifies rooms as such on the basis of information from its exploratory tour.

For example, the mobile self-propelled appliance has the map of its surroundings from the exploratory tour. On the basis of the geometry, the appliance itself can assess which areas in reality correspond to rooms. Narrowed areas that lie between neighboring rooms in the surroundings map are identified as doors or door thresholds and thus classified as passable.

Alternatively, it is possible for the user to specify which surfaces or areas of the surroundings map correspond to which rooms of their apartment via their app on the portable additional device itself. Also in this case, the appliance can automatically identify narrowed areas between neighboring rooms as doors or door thresholds and thus classify them as passable.

In one advantageous embodiment, the classification of obstacles is performed before an attempt is made to drive over the obstacle. In this case, an attempt to overcome the obstacle is not made in the case of obstacles that are classified as not passable, in order to prevent possible damage to the obstacles or the mobile, self-propelled appliance from becoming stuck.

In one advantageous embodiment, the mobile self-propelled appliance determines a position of detected obstacles in the surroundings map. In particular, it is determined as precisely as possible where the detected obstacle is located in the surroundings map. If the obstacle is located in an area near to a door or a room transition, the obstacle is classified as a threshold, in particular a door or room threshold, which can be overcome. If the identified obstacle is within a room, it is assumed to be a piece of furniture. During the cleaning process, the mobile, self-propelled appliance will drive around said piece of furniture.

In particular, obstacles near to a door or wall are classified as door thresholds and obstacles far from a door or wall are classified as furniture, wherein obstacles near to a door are driven over and obstacles far from a door are driven around before an attempt is made to drive over the obstacles far from a door.

According to the invention, a mobile, self-propelled appliance, in particular a floor cleaning appliance for autonomous processing of floor surfaces such as a suction and/or sweeping and/or mopping robot, comprises a detection unit for detecting obstacles and an evaluation unit for classifying the obstacles as passable or not passable. In particular, the detection unit comprises sensors that determine distance measurement values and/or temporal changes of sensor values.

Any features, designs, embodiments and advantages concerning the method are also applicable in connection with the mobile, self-propelled appliance according to the invention, and vice versa.

An evaluation unit is understood to be in particular any facility suitable for being able to perform an appropriate classification of the obstacles and/or objects as passable or not passable, in particular on the basis of the position of the obstacle in its surroundings. A more detailed classification of the obstacles is not necessarily required but may be implemented.

In order to identify an obstacle before the mobile self-propelled appliance drives into it, sensor technology similar to the known cliff sensors can be used. If their distance measurement value increases, the mobile, self-propelled appliance is at a precipice or has been lifted up by the user. However, if the measured value decreases by a certain value, it is a threshold.

In addition to the use of the cliff sensors built into the appliance, further installation devices can be used that enable a reliable identification of thresholds. Raised positions and/or inclined installation positions of the sensors ensure that the threshold is identified before it comes into contact with the appliance. Positions in front, in particular positions that can be lowered in a resilient manner, enable identification at a short distance.

Furthermore, the temporal change of the sensor values can be detected in order to distinguish between flat obstacles, such as for example floor-level supporting struts of swing chairs, flat feet of tables or similar, and carpets. In the case of smooth obstacles, a continuous profile shape can be identified in the temporal course of the sensor values, whereas a rough structure in the case of carpets provides irregular sensor values.

Alternatively, the obstacle can be identified by a second bumper at the height of the obstacle in the approach slope. In this case, the spring force is selected so that a soft obstacle such as a carpet can be identified as such and distinguished from an obstacle such as a supporting strut of a chair.

Due to the existing map data of the rooms of the surroundings map, a threshold is reliably identified as such, wherein the appliance can check and classify whether it is a door threshold or an obstacle located within the room. The appliance passes door thresholds and drives around other obstacles.

BRIEF DESCRIPTION OF THE FIGURES

The invention will be explained in more detail with the aid of the following embodiments of the invention, which merely illustrate examples. In the drawing.

DETAILED DESCRIPTION OF THE INVENTION

Figure 1:
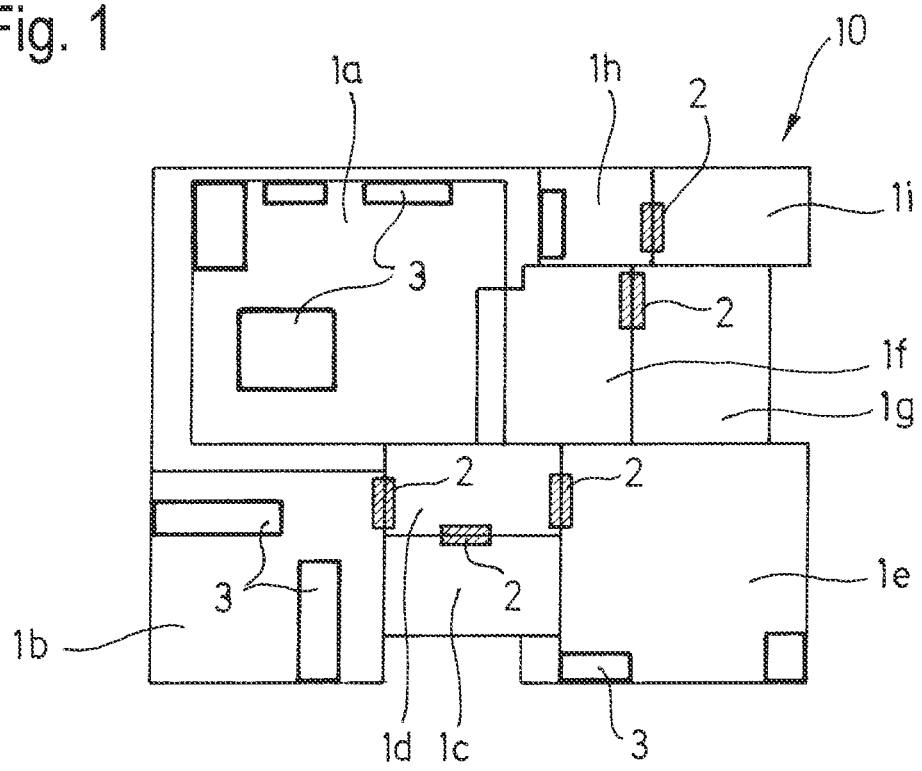
FIG. 1: shows a schematic view of an exemplary embodiment of a surroundings map, which is produced when performing the method according to the invention for the automatic processing of floor surfaces with the aid of a mobile, self-propelled appliance.

FIG. 1 shows a surroundings map 10 which has been produced by a mobile, self-propelled appliance, in particular a suction robot, during an exploratory tour. During the exploratory tour, all obstacles such as, for example, furniture, door thresholds, carpets and curtains hanging down in a predetermined floor processing area are detected by a detection facility of the suction robot. Due to the geometry in the surroundings map, the suction robot itself can estimate which areas correspond to rooms in reality. In particular, individual boundaries in the surroundings map correspond to individual room sections and/or individual rooms 1*a*-1*i*.

As an alternative to the automatic classification of the rooms by the suction robot, the user can specify via an app, for example on their mobile device, which boundaries of the surroundings map correspond to which rooms 1*a*-1*i* of their apartment.

In addition to the rooms, any obstacles located in the rooms are detected by the suction robot. The suction robot classifies narrowed areas that are located between neighboring rooms in the surroundings map as doors and/or door areas and/or door thresholds and separates them from obstacles 3 that are located within a room. If the suction robot identifies an obstacle 2, 3 in front of it during a tour, it is possible for said suction robot to check where the obstacle 2, 3 is located on the basis of the position known to it in the surroundings map 10. If this obstacle is located in an area near to a door or between two neighboring rooms, the obstacle 2 is classified as a door threshold that can be overcome or driven over. If the identified obstacle 3 is inside a room, said obstacle is classified as a piece of furniture. The suction robot drives around it during the cleaning process. In this case, an attempt to drive over or overcome the obstacle 3 is not made in order to prevent damage and/or the suction robot from becoming stuck.

In particular, the suction robot classifies the obstacles 2, 3 as passable or not passable, depending on the position of the obstacle 2, 3 in the created surroundings map. In this case, obstacles 2 near to a door are classified as door thresholds and obstacles 3 far from a door are classified as furniture. As a result of the classification, obstacles 2 near to a door are driven over and obstacles 3 far from a door are driven around before an attempt is made to drive over the obstacles 3 far from a door. Following the classification of the obstacles 2, 3, obstacles 2 classified as passable are therefore driven over and obstacles 3 classified as not passable are driven around.

Figure 2:
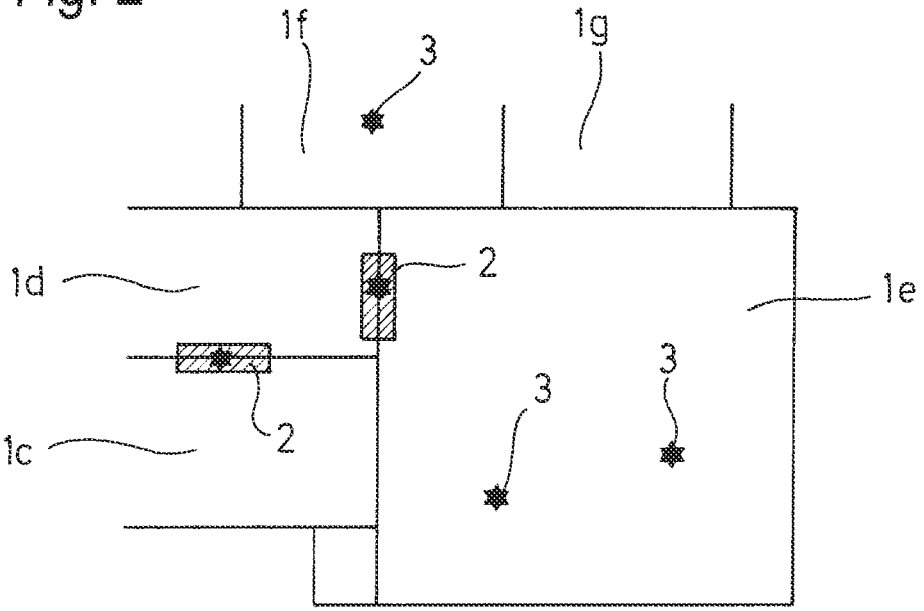
FIG. 2: shows a schematic section of the surroundings map of the exemplary embodiment of FIG. 1, FIGS. 3A-3C: show a schematic cross-section of an exemplary embodiment of a mobile, self-propelled appliance during the implementation of the method according to the invention for the automatic processing of floor surfaces.

FIG. 2 shows a section of the surroundings map 10 of the exemplary embodiment of FIG. 1. The suction robot has identified individual rooms 1*c* to 1*g* in the surroundings map and stored them accordingly. Between individual rooms 1*d* and 1*e*, 1*c* and 1*d*, the suction robot has detected obstacles 2 and classified them as door thresholds on the basis of their position between rooms. These obstacles 2 which are near to a door or wall can be driven over during the cleaning program of the suction robot without in so doing the obstacle becoming damaged or the suction robot becoming stuck. Obstacles 3 that are located inside a room due to their position are classified as pieces of furniture. These obstacles 3 which are far from a door or wall are driven around during the cleaning program of the suction robot without said suction robot attempting to drive over them, thus preventing damage to the obstacle 3 or the suction robot from becoming stuck.

Figure 3:
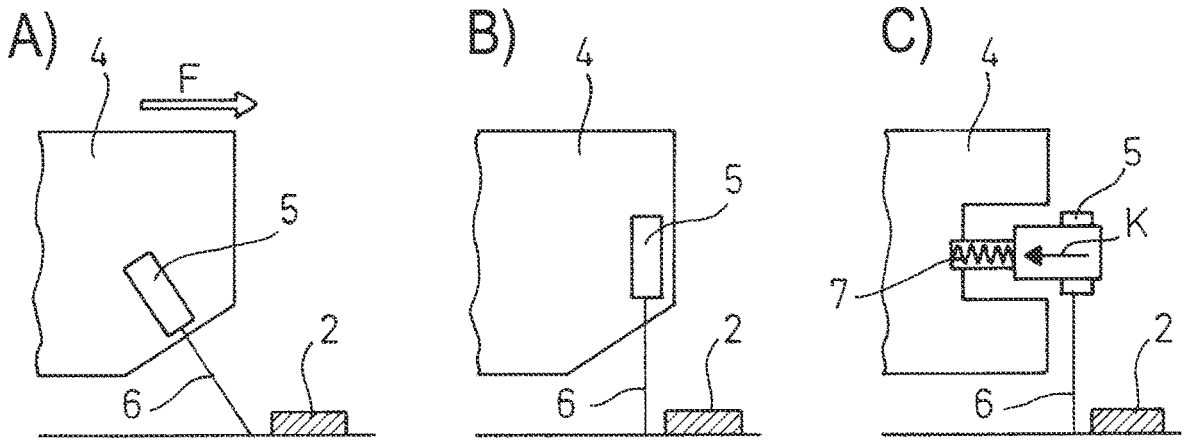

FIG. 3 shows a lateral view of a suction robot 4 that detects an obstacle 2 as a door threshold and classifies it as such. In order to identify a door threshold before the suction robot 4 touches it or drives onto it, the suction robot comprises at least one distance-measuring sensor 5, which is similar to known cliff sensors. If the distance measurement value increases, the suction robot 4 is at a precipice or has been lifted up by the user. If, on the other hand, the distance measurement value decreases by a certain amount within a defined range, a door threshold is identified as such. This means that door thresholds can be identified before the suction robot physically touches them or before it reaches them.

In FIG. 3A, the suction robot 4 is travelling in the direction of travel F and using its distance-measuring sensor 5 detects obstacles along its laser beam 6. FIG. 3B shows an alternative arrangement of the distance-measuring sensor 5 in the suction robot 4. In FIG. 3C, an arrangement of the sensor 5 is used in which the sensor is mounted at the front and in such a manner that it can be resiliently lowered on the suction robot 4, this arrangement enables obstacles to be detected even at a short distance. For this purpose, the sensor 5 is attached to a spring 7. The spring 7 can be retracted in the direction K so that the sensor 5 can be lowered in the suction robot, whereby it is protected from impacts and damage in the retracted state.

In addition, it is preferred that a temporal change in the distance measurement values of the sensor 5 is recorded in order to enable a distinction to be made between smooth obstacles, such as floor-level supporting struts of swivel chairs or flat feet of tables, and rough obstacles, such as carpets. In the case of smooth obstacles, a continuous profile shape results in the temporal course of the sensor values, whereas irregular sensor values are provided by a rough structure.

Alternatively, the obstacle to be detected can be detected by a bumper at the height of the obstacle in the approach slope (not shown). In this case, a spring force of the bumper is selected so that a soft obstacle such as, for example, a carpet is identified as such and can be distinguished from an obstacle such as, for example, a supporting strut of a chair.

If a surroundings map with identified rooms is available and a door threshold is detected as such by the suction robot, the suction robot can check and classify whether it is a door threshold or an obstacle located within the room. The suction robot passes door thresholds and drives around other obstacles.

Figure 4:
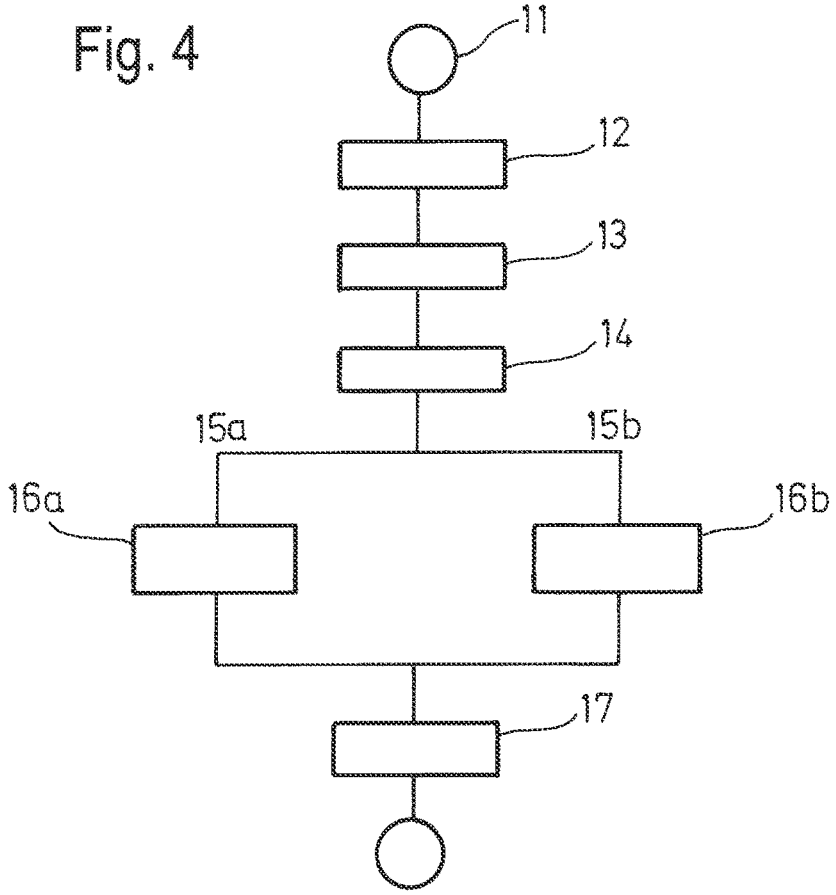
FIG. 4: shows a schematic flow chart of the sequence of the method according to the invention for the automatic processing of floor surfaces.

FIG. 4 shows a flow chart in this regard. Initially, in method step 11, the suction robot performs an exploratory tour in a designated floor processing area and creates a map of its surroundings. In method step 12, the suction robot now moves in its known surroundings, for example in order to fulfill a cleaning task. The suction robot can access the surroundings map with identified or indicated rooms. In method step 13, the suction robot uses its sensors to detect an obstacle in front of it, for example a door threshold. The suction robot checks with the aid of its surroundings map whether the obstacle is in a door area (step 14). If the obstacle is located in an area between two rooms or in an area released by the user (path 15*a*), the obstacle is classified as passable, for example as a door threshold. The suction robot attempts to overcome the obstacle in method step 16*a*. If, on the other hand, the obstacle is inside a room (path 15*b*), the obstacle is classified as not passable, for example as a piece of furniture. The suction robot evaluates the obstacle as such and searches for a way to drive round it without attempting to drive over it (step 16*b*). After driving over or around the detected and classified obstacle, the suction robot continues its movement and its cleaning task in step 17.

The obstacle is therefore classified on the basis of the position or the location of the identified obstacle in the surroundings map, and the further procedure of the suction robot is decided accordingly. This significantly reduces the risk of the suction robot becoming stuck on flat obstacles such as floor-level supporting struts of chairs. In addition, the risk of damaging high-quality furniture by driving over or attempting to drive over it is reduced. Also, the wear marks on the suction robot itself are reduced due to less direct contact with obstacles. Less noise and a lower risk of becoming stuck during the cleaning task is an advantage. Overall, the cleaning time can be advantageously reduced, since attempts by the suction robot to overcome obstacles are prevented from the outset.

The invention claimed is:

1. A method of autonomously processing floor surfaces with a mobile, self-propelled appliance, the method comprising the following method steps:
   - performing an exploratory tour by the mobile, self-propelled appliance in a designated floor processing area to create a surroundings map;
   - detecting obstacles by way of a detection facility;
   - determining a position of detected obstacles in the surroundings map;
   - classifying the obstacles as being passable or not passable based on the determined position of the obstacle, and classifying obstacles near a door as door thresholds and classifying obstacles far from a door as furniture; and
   - selectively driving over an obstacle that is classified as passable and driving around an obstacle that is classified as not passable, and driving over obstacles near to a door and driving around obstacles far from a door before an attempt is made to drive over the obstacles far from a door.

2. The method according to claim 1, wherein the mobile, self-propelled appliance is a floor cleaning appliance being a suction robot, and/or a sweeping robot, and/or a mopping robot.

3. The method according to claim 1, which comprises classifying the obstacles with the aid of existing map data obtained by the exploratory tour.

4. The method according to claim 3, which comprises classifying the obstacles by comparing information from the exploratory tour and information from the detection of the obstacle.

5. The method according to claim 1, which comprises classifying the obstacles before making an attempt to drive over a respective obstacle.

6. The method according to claim 1, which comprises, in order to perform a classification of the obstacles, automatically identifying with the mobile, self-propelled appliance rooms as such on a basis of information from the exploratory tour.

7. A mobile, self-propelled appliance, comprising:
   - a detection unit for detecting obstacles;
   - an evaluation unit for classifying the obstacles as passable or not passable; and
   - wherein the appliance is configured for performing the method according to claim 1.

8. The appliance according to claim 7 configured as a floor cleaning appliance being a suction robot, and/or a sweeping robot, and/or a mopping robot.

9. The appliance according to claim 7, wherein said detection unit comprises sensors configured to determine distance measurement values and/or temporal changes of sensor values.

* * * * *